US010974523B2

(12) United States Patent
Miyazawa

(10) Patent No.: US 10,974,523 B2
(45) Date of Patent: Apr. 13, 2021

(54) PROCESSING APPARATUS

(71) Applicant: SEIKO EPSON CORPORATION, Tokyo (JP)

(72) Inventor: Masaki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 35 days.

(21) Appl. No.: 16/354,457

(22) Filed: Mar. 15, 2019

(65) Prior Publication Data

US 2019/0283465 A1 Sep. 19, 2019

(30) Foreign Application Priority Data

Mar. 19, 2018 (JP) ..... JP2018-051074

(51) Int. Cl.
*B41J 11/00* (2006.01)
*B41J 13/10* (2006.01)
*B65H 29/70* (2006.01)

(52) U.S. Cl.
CPC ..... *B41J 11/0015* (2013.01); *B41J 13/106* (2013.01); *B65H 29/70* (2013.01)

(58) Field of Classification Search
CPC ..... B65H 29/70; B65H 2513/42; B65H 2220/04; B65H 2404/63; B65H 2404/1341; B65H 2404/1441; B65H 2404/1521; B41J 13/106; B41J 11/0005
See application file for complete search history.

(56) References Cited

U.S. PATENT DOCUMENTS 3,087,724 A * 4/1963 Jones ..... B65H 31/36 271/188
4,469,319 A * 9/1984 Robb ..... B65H 3/042 271/171
6,089,567 A * 7/2000 Yatsuhashi ..... B65H 27/00 271/188
6,181,908 B1 * 1/2001 Leemhuis ..... B65H 29/70 271/188
6,776,408 B2 * 8/2004 Suzuki ..... B65H 29/60 271/188
7,431,289 B2 * 10/2008 Sekiyama ..... B65H 29/14 271/188
8,235,383 B2 * 8/2012 Masaki ..... G03G 15/6552 271/188
10,358,312 B2 * 7/2019 Okawa ..... B65H 31/02
(Continued)

FOREIGN PATENT DOCUMENTS

JP 2014-196182 A 10/2014
JP 2016-160030 A 9/2016
JP 2016-166094 A 9/2016

*Primary Examiner* — John Zimmermann
(74) *Attorney, Agent, or Firm* — Workman Nydegger

(57) ABSTRACT

A processing apparatus includes a processing section configured to perform processing to a medium, a discharge section configured to discharge the medium that has been transported from the processing section along a medium transport path, and a first contact section configured to come into contact with the medium that has passed through the processing section and being transported toward the discharge section in the medium transport path to press the medium from one side toward the other side. The first contact section is switched between a first position for pressing the medium and a second position that is closer to the one side than the first position.

17 Claims, 15 Drawing Sheets

(56) References Cited

U.S. PATENT DOCUMENTS

| | | | | |
|---|---|---|---|---|
| 2008/0191410 | A1* | 8/2008 | Shinohara | B65H 31/02<br>271/209 |
| 2014/0292978 | A1 | 10/2014 | Kodama et al. | |
| 2014/0292979 | A1* | 10/2014 | Kodama | B41J 13/106<br>347/104 |
| 2016/0257136 | A1 | 9/2016 | Ueno | |

* cited by examiner

PROCESSING APPARATUS

CROSS REFERENCES TO RELATED APPLICATIONS

The entire disclosure of Japanese Patent Application No. 2018-051074, filed Mar. 19, 2018 is expressly incorporated by reference herein.

BACKGROUND

1. Technical Field

The present disclosure relates to a processing apparatus for processing a medium.

2. Related Art

There are processing apparatuses that are provided with recording apparatuses having a recording section for ejecting ink, which is an example liquid, onto paper, which is an example medium, to record images, or the like and discharge the recorded paper to a discharge tray. These recording apparatuses are called ink jet printers. In such printers, in some cases, the ink ejected from the recording section and adhered to the paper causes the paper to curl (corrugate) and the curling paper is discharged to the discharge tray, resulting in the decrease in the stacking properties.

JP-A-2016-166094 discloses a recording apparatus that includes a discharge section for discharging a medium. The recording apparatus includes a first acting section that acts so that first portions of paper outside both sides of the discharge section are located on a lower side of a nipping position of a discharge driving roller and a discharge driven roller in a recording surface intersecting direction that intersects a recording surface and a second acting section that acts so that second portions of the paper outside both sides of the first portions in a width direction of the discharged paper are located on an upper side of the first portions. Specifically, paper is corrugated in the width direction by the first portions and the second portions to reduce the curling of the paper.

The recording apparatus disclosed in JP-A-2016-166094, however, applies a pressing force to the paper by the first portions and the second portions, and depending on the paper condition, the recording apparatus may cause damage such as scratches on the paper surface by the first portions or the second portions that strongly press the paper surface at the positions where the first portions or the second portions come into contact with the paper, and there is a room for improvement in this respect.

SUMMARY

An advantage of some aspects of the disclosure is that there is provided a processing apparatus capable of achieving good medium stacking properties and reducing the occurrence of damage to a medium.

According to an aspect of the disclosure, a processing apparatus includes a processing section configured to perform processing to a medium, a discharge section configured to discharge the medium that has been transported from the processing section along a medium transport path, and a first contact section configured to come into contact with the medium that has passed through the processing section and being transported toward the discharge section in the medium transport path to press the medium from one side toward the other side, in which the first contact section is switched between a first position for pressing the medium and a second position that is closer to the one side than the first position.

According to this aspect, a processing apparatus includes a first contact section configured to come into contact with the medium from one side, which is one surface side of the medium, toward the other side, which is the other surface side of the medium. The processing apparatus can switch the first contact section between a first position for pressing the medium to increase the stiffness of the medium and a second position that is closer to the one side than the first position. Accordingly, by switching the first contact section to the first position, the medium can be corrugated in a medium width direction that is a direction intersecting a medium transport direction, and good medium stacking properties can be achieved. The first contact section is switched to the second position at a timing in discharging the medium. With this operation, the pressing force of the first contact section for pressing the surface of the medium can be released and the occurrence of damage to the medium can be reduced.

It is preferable that the processing apparatus further include a second contact section disposed away from the first contact section in a medium width direction that is a direction intersecting the medium transport direction, the second contact section being configured to come into contact with the medium being transported toward the discharge section to press the medium from the other side toward the one side.

In this structure, the processing apparatus includes a second contact section disposed away from the first contact section in a medium width direction that is a direction intersecting the medium transport direction, the second contact section being configured to come into contact with the medium being transported toward the discharge section to press the medium from the other side toward the one side. Accordingly, the medium can be more reliably corrugated in the medium width direction.

It is preferable that the discharge section be disposed in a central area in the medium width direction, the first contact section be disposed outside the discharge section in the medium width direction, and the second contact section be disposed outside the first contact section in the medium width direction.

With the structure in which the discharge section is disposed in a central area in the medium width direction, the first contact section is disposed outside the discharge section in the medium width direction, and the second contact section is disposed outside the first contact section in the medium width direction, a functional effect similar to the above-described functional effect can be achieved.

It is preferable that the position at which the first contact section in the first position come into contact with the medium be closer to the other side than the position at which the second contact section come into contact with the medium.

In this structure, the position at which the first contact section in the first position comes into contact with the medium is closer to the other side than the position at which the second contact section comes into contact with the medium. Accordingly, the medium can be reliably corrugated in the medium width direction by the first contact section and the second contact section.

It is preferable that the second contact section be on an upstream side of the first contact section in the medium transport path. With the structure in which the second contact section is on an upstream side of the first contact section in the medium transport path, some of the above-described operational effects can be achieved.

It is preferable that the first contact section be disposed at a higher position with respect to the medium transport path and the second contact section be disposed at a lower position with respect to the medium transport path.

With the structure in which the first contact section is disposed at a higher position with respect to the medium transport path and the second contact section is disposed at a lower position with respect to the medium transport path, some of the above-described operational effects can be achieved.

It is preferable that the position at which the second contact section comes into contact with the medium be higher than the position at which the first contact section in the first position comes into contact with the medium and be lower than the position at which the discharge section comes into contact with the medium.

With this structure, the position at which the second contact section comes into contact with the medium is higher than the position at which the first contact section in the first position comes into contact with the medium and is lower than the position at which the discharge section comes into contact with the medium. Accordingly, the medium can be more reliably corrugated in the medium width direction.

It is preferable that the position at which the first contact section in the second position comes into contact with the medium be a substantially the same height as the position at which the second contact section comes into contact with the medium or be lower than the position at which the second contact section comes into contact with the medium.

With this structure, the position at which the first contact section in the second position comes into contact with the medium is a substantially the same height as the position at which the second contact section comes into contact with the medium or is lower than the position at which the second contact section comes into contact with the medium. Accordingly, even if the first contact section is switched to the second position, it can be expected that the corrugated shapes will remain to some extent in the medium and the curl reducing effect can be continuously achieved.

It is preferable that the position at which the first contact section in the second position comes into contact with the medium be higher than the position at which the second contact section comes into contact with the medium.

With this structure, the position at which the first contact section in the second position comes into contact with the medium is higher than the position at which the second contact section comes into contact with the medium. Accordingly, the pressing force of the first contact section for pressing the surface of the medium can be more reliably released and the occurrence of damage to the medium can be more reliably reduced.

It is preferable that a plurality of the first contact sections, or a plurality of the second contact sections, or a plurality of first contact sections and the second contact sections be disposed in the medium width direction.

With this structure, a plurality of the first contact sections, or a plurality of the second contact sections, or a plurality of first contact sections and the second contact sections are disposed in the medium width direction, and the medium can be more reliably corrugated in the medium width direction.

It is preferable that when a leading edge of the medium reaches the first contact section, the first contact section be in the first position and by the time a trailing edge of the medium passes through the first contact section, the first contact section be switched from the first position to the second position.

With this structure, when a leading edge of the medium reaches the first contact section, the first contact section is in the first position and by the time a trailing edge of the medium passes through the first contact section, the first contact section is switched from the first position to the second position. Accordingly, the effect of reducing the occurrence of damage to the medium by the first contact section can be achieved in a predetermined area in the medium.

It is preferable that the first contact section be switched from the first position to the second position when a central position of the medium in the discharge direction reaches the discharge section.

When a central position of the medium in the discharge direction reaches the discharge section, the position of the center of gravity in the medium becomes on the downstream side of the discharge section, and the portion of the medium on the downstream side will automatically fall with the discharge section as a fulcrum. Accordingly, the portion of the medium on the upstream side comes into contact with the first contact section with a strong force the medium is more likely to be damaged by the first contact section. With this structure, in such a case, the first contact section is switched from the first position to the second position and thereby the occurrence of damage to the medium by the first contact section can be effectively reduced.

It is preferable that the first contact section be switched from the first position to the second position step by step. Since the first contact section is switched from the first position to the second position step by step, sudden change in the orientation of the medium in discharging the medium can be reduced and good stacking properties can be achieved.

It is preferable that depending on the type of medium, a discharging operation to be performed in a state in which the first contact section is in the first position and a discharging operation to be performed in a state in which the first contact section is in the second position be switched.

For example, if the medium is paper that has high stiffness such as thick paper, since the medium does not easily curl, it is substantially not necessary to press the medium to corrugate with the pressing force by the first contact section to reduce curling to achieve good stacking properties. Moreover, in the case of the medium that has high stiffness, the pressure from the first contact section would damage the medium surface. Consequently, in such a case, the medium is discharged in the state in which the first contact section is in the second position. On the other hand, if the medium is paper that has low stiffness such as thin paper, since the medium easily curl, it is necessary to press the medium by the first contact section to corrugate the medium to reduce curling to achieve good stacking properties. Accordingly, in such a case, the medium is discharged in a state in which the first contact section is in the first position. For example, as described above, depending on the type of medium, a discharging operation to be performed in a state in which the first contact section is in the first position and a discharging operation to be performed in a state in which the first contact section is in the second position are switched, and thereby a discharging operation appropriate for the medium type can be performed.

It is preferable that the processing section include a recording unit configured to perform recording onto the medium. With this structure in which the processing section includes a recording unit configured to perform recording onto the medium, some of the above-described functional effects can be achieved.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
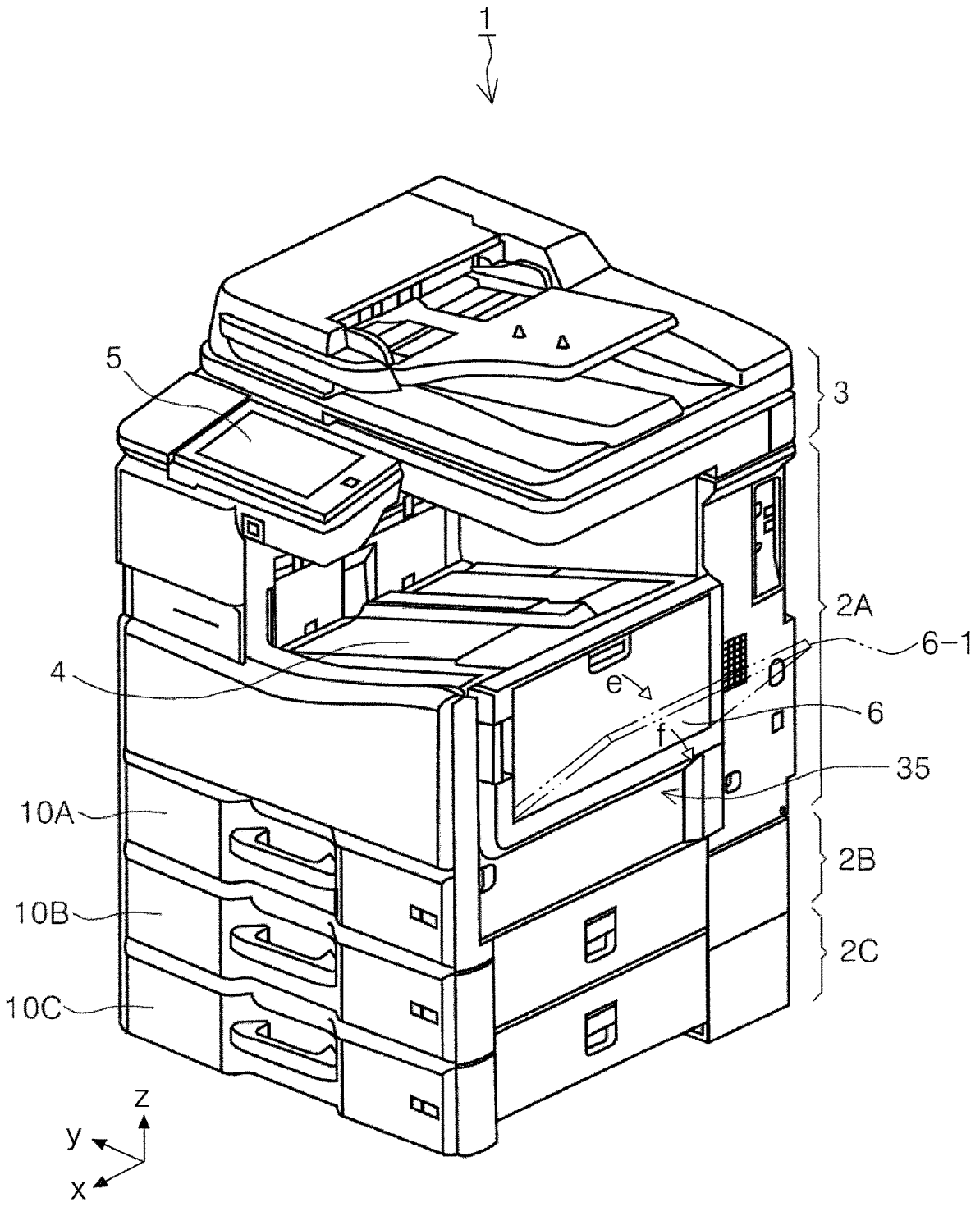
FIG. 1 is an external perspective view of an ink jet printer according to an embodiment of the disclosure.

Hereinafter, a processing apparatus according to an embodiment of the disclosure will be described with reference to the drawings. In the following description, an ink jet printer (hereinafter, simply referred to as a "printer") 1 will be described as an example processing apparatus according to the embodiment of the disclosure. The method of performing recording onto a sheet, which is an example medium, is not limited to the ink jet system, and various systems such as an electrophotographic system or a dot impact system may be employed. The ink jet systems include various systems such as a system having an ink cartridge that is attached to a carriage, a system that has an ink accommodating section provided outside a carriage and the ink accommodating section and the carriage are connected by an ink tube, and the like. Embodiments of the disclosure can be applied to any of the systems. The printer 1 according to the embodiment has an ink accommodating section that is provided outside a carriage and the ink accommodating section and the carriage are connected by an ink tube. Recording heads for discharging ink includes recording heads that move in a sheet width direction and recording heads that are immovable and have a size enough to cover a sheet width direction. The printer 1 according to the embodiment is the latter type.

In an x-y-z coordinate system in the drawings, an x direction denotes an apparatus depth direction and a sheet width direction, and a y direction denotes an apparatus width direction, and a z direction denotes an apparatus height direction and a gravity direction. A direction toward which a sheet is transported is referred to as "downstream" and the opposite direction is referred to as "upstream".

Figure 2:
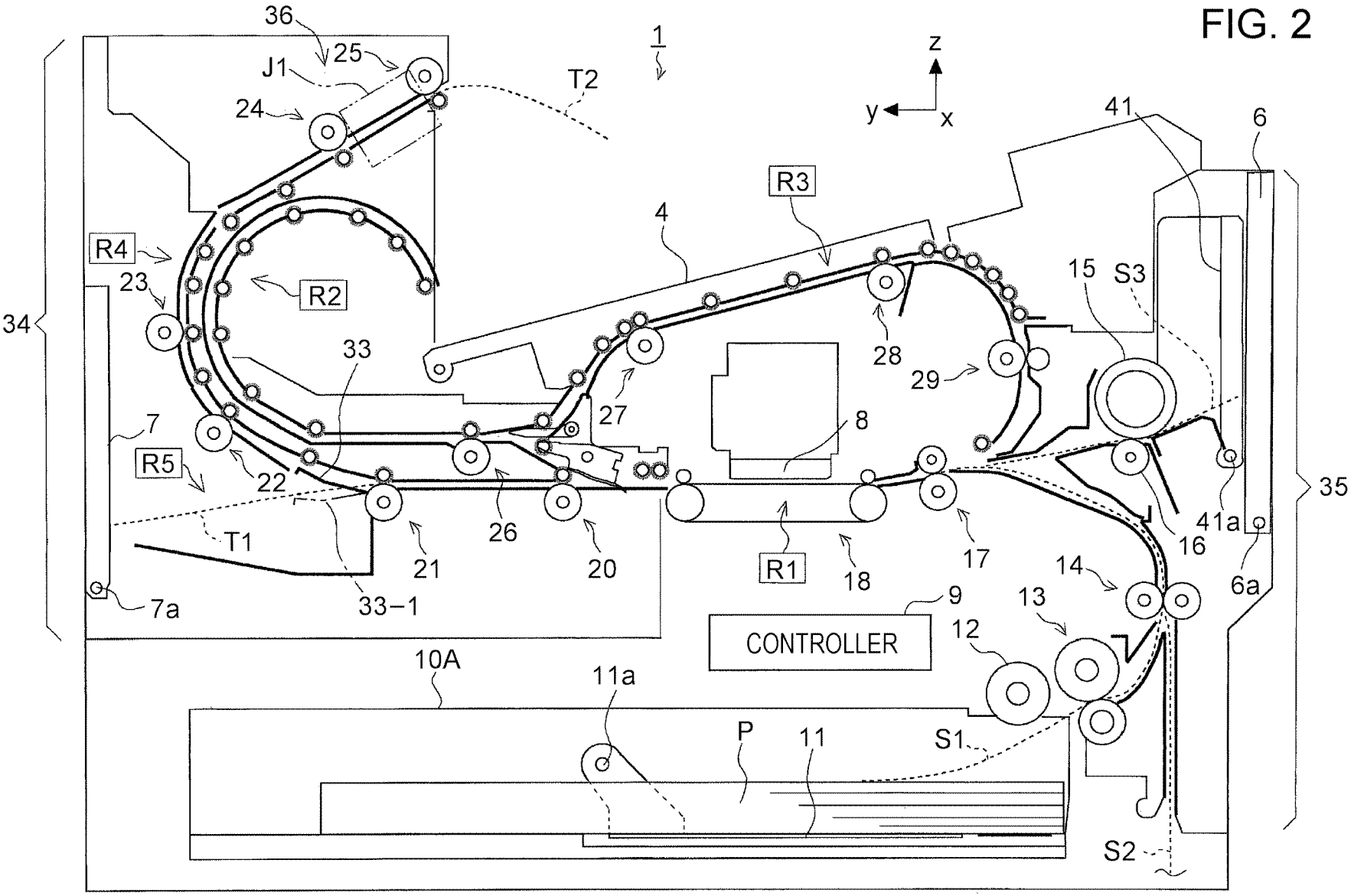
FIG. 2 is a side cross-sectional view illustrating an overall sheet transport path of an ink jet printer according to an embodiment of the disclosure.

With reference to FIG. 1 and FIG. 2, an overall structure of the printer 1 will be described. In FIG. 1, the printer 1 includes a scanner section 3 on an apparatus body 2A and expansion units 2B and 2C under the apparatus body 2A. The apparatus body 2A includes a paper cassette 10A, the expansion unit 2B includes a paper cassette 10B, and the expansion unit 2C includes a paper cassette 10C. The expansion units 2B and 2C are optional units for increasing the number of sheets accommodated in the apparatus body 2A, and are optionally attached to the apparatus body 2A.

An operation section 5 is used to perform various operations to the printer 1. A tray 4 receives a discharged recorded sheet, specifically, a face-down discharge tray that receives a sheet that is discharged with a surface placed face down onto which recording has been performed most recently. A feeding unit 35 rotates about a pivot point (not illustrated) to be opened or closed with respect to the apparatus body 2A.

The feeding unit 35 includes an access cover 6. The access cover 6 can swing open about a pivot shaft 6*a* (FIG. 2) in directions indicated by arrows e and f. Virtual lines and a reference numeral 6-1 in FIG. 1 denote the access cover being opened or closed. A manual feed tray 41 (FIG. 2) is disposed inside the access cover 6. The manual feed tray 41 can swing open about a pivot shaft 41*a* together with the access cover 6. The manual feed tray 41 in FIG. 2 is in a storage position, and from the state in FIG. 2, the manual feed tray 41 can be opened in the clockwise direction to enable a user to manually feed paper in an obliquely upwardly inclined state.

A side of the printer 1 on which the operation section 5 is disposed is an apparatus front side, and a side on which the access cover 6 is disposed is an apparatus right side. Specifically, feeding, transporting, and discharging of a sheet in the printer 1 is performed along the apparatus right-left direction.

Sheet transport paths in the printer 1 will be described with reference to FIG. 2. The printer 1 includes three sheet feeding paths: a feeding path (see a cassette feeding trajectory S1) from the paper cassette 10A, a feeding path (see an expansion cassette feeding trajectory S2) from the paper cassettes 10B and 10C (not illustrated in FIG. 2), and a feeding path (see a manual feeding path S3) from the manual feed tray 41 on which a sheet is to be mounted.

The printer 1 has two sheet discharging methods: a face-up discharging (see a face-up discharge trajectory T1) for discharging a sheet with a surface placed face up onto which recording has been performed most recently and a face-down discharging (see a face-down discharge trajectory T2) for discharging a sheet with a surface placed face down onto which recording has been performed most recently.

A face-up discharge tray 7 in FIG. 2 receives a sheet that is discharged face up. The face-up discharge tray 7 is rotated about a rotating shaft 7*a* for the storage state illustrated in FIG. 2 or an open state (not illustrated).

The printer 1 includes five sheet transport paths: a recording transport path R1, a switchback path R2, a reversing path R3, a face-down discharge path R4, and a face-up discharge path R5.

In FIG. 2, a flap (path switching member) 33 is driven by a drive source (not illustrated). The flap 33 can be switched between a state indicated by a solid line 33 and a state indicated by a virtual line 33-1 in FIG. 2.

Figure 3:
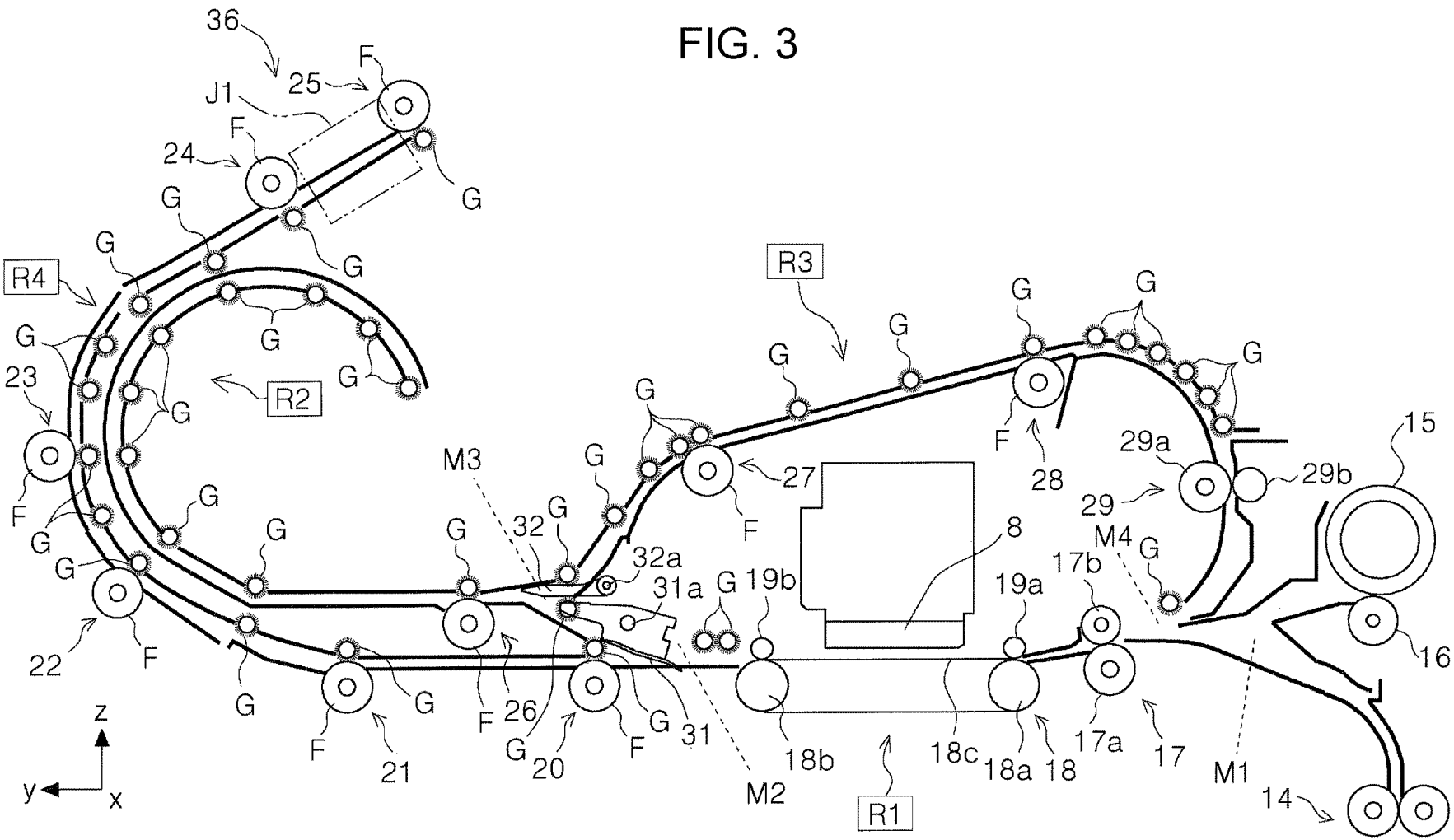
FIG. 3 is a side cross-sectional view illustrating a part of a sheet transport path of an ink jet printer according to an embodiment of the disclosure.

When the flap 33 is in the state indicated by the solid line in FIG. 2, a sheet is guided to the face-down discharge path R4 and discharged face down as illustrated by the face-down discharge trajectory T2. A discharge mechanism section 36 is disposed most downstream of the face-down discharge path R4. In FIG. 2 and FIG. 3, a plurality of driven rollers (spurs) are disposed in an area J1, and the driven rollers (spurs) disposed in the area J1 will be described below with reference to FIG. 4 and subsequent figures. When the flap 33 is in the state indicated by the virtual line 33-1 in FIG. 2, a sheet is guided to the face-up discharge path R5 and discharged face up as illustrated by the face-up discharge trajectory T1.

In FIG. 2, a controller 9 performs various control processes. The controller 9 acquires recording data for recording that is generated by a printer driver that operates on an external computer (not illustrated) or a printer driver in the controller 9. Based on the recording data, the controller 9 controls an ink jet recording head (hereinafter, referred to as a "recording head") 8, various sheet transport rollers that are driven by motors (not illustrated), path switching members (flaps), and other components. The controller 9 performs necessary control processing based on detection results of various sensors, for example, a sensor for detecting passage of a sheet. The controller 9 in FIG. 2 is a conceptual example, and practically, the controller 9 may comprise a circuit board that is disposed at a predetermined position in the apparatus body 2A. Hereinafter, with reference to FIG. 2, a sheet feeding path to a registration roller pair 17 will be described.

The paper cassette 10A that is detachably attached to the apparatus body 2A includes a hopper 11. The hopper 11 swings about a shaft 11*a* so that a sheet stored in the paper cassette 10A comes into contact with or separates from a feeding roller 12, which is driven by a motor (not illustrated) to rotate.

A sheet that is fed from the paper cassette 10A by the feeding roller 12 passes through a nip position of a separation roller pair 13 and is separated (multi-sheet feeding is prevented), is subjected to a feeding force from a transport roller pair 14, and reaches the registration roller pair 17. Similarly, each of the expansion units 2B and 2C (FIG. 1), which are disposed under the apparatus body 2A, includes the feeding roller 12 and the separation roller pair 13. A sheet fed from each paper cassette is subjected to a feeding force from the transport roller pair 14 illustrated in FIG. 2 and reaches the registration roller pair 17. The sheet feeding path (manual feeding path S3) from the manual feed tray 41 has a feeding roller 15 and a separation roller 16. A sheet that is set on the manual feed tray 41 reaches the registration roller pair 17 by the rotation of these rollers.

Hereinafter, the sheet transport paths on the downstream side of the registration roller pair 17 will be described with reference to FIG. 3. In FIG. 3, it is assumed that a sheet is discharged face down via the face-down discharge path R4.

First, rollers that are disposed in each sheet transport path will be described. FIG. 3 illustrates the registration roller pair 17, transport roller pairs 20 to 24 and 26 to 29 all for transporting a sheet, and a discharge roller pair 25 for discharging a sheet. In each roller pair except the registration roller pair 17 and the transport roller pair 26, the roller on one side in the roller pair is indicated by a reference numeral F, and the roller on the other side is indicated by a reference numeral G. The discharge roller pair 25 that is disposed most downstream of the face-down discharge path R4 serves as a discharge section for discharging a sheet from the face-down discharge path R4.

The rollers F are driving rollers that are driven by motors (not illustrated), and for example, rubber rollers that are disposed at appropriate intervals in the sheet width direction. The rollers G are driven rollers that are driven to rotate while coming into contact with a sheet and can nip the sheet with the rollers F by urging members (not illustrated). The rollers G are provided together with the rollers F as pairs and are disposed at appropriate intervals in the sheet width direction. The roller G is a serrated roller that has a plurality of teeth on its outer circumference. The roller G comes into contact with a recording surface at a point to reduce the occurrence of white patches of ink and transferring of ink onto the recording surface. Each of the driven rollers G comprises each transport roller pair and is disposed at an appropriate position in the sheet transport paths, particularly, provided on the side the driven roller G comes into contact with a surface on which recording has been made most recently. Driven rollers in the discharge mechanism section 36 have a structure similar to that of the driven rollers G as will be described below.

On the other hand, the registration roller pair 17 and the transport roller pair 29 have structures different from that of the above-described roller pairs. Specifically, the transport roller pair 29 has a driving roller 29*a* that is driven to rotate and a driven roller 29*b* that is pressed against the driving roller 29*a* and can be driven to rotate. The driven roller 29*b* is a resin roller that has a smooth outer circumferential surface.

The registration roller pair 17 has a driving roller 17*a* that is driven to rotate and a driven roller 17*b* that is pressed against the driving roller 17*a* by an urging member (not illustrated) and can be driven to rotate. The driving roller 17*a* has a fine uneven outer circumferential surface. The driven roller 17*b* is a resin roller that has a smooth outer circumferential surface. A plurality of driving rollers 17*a* are disposed at appropriate intervals along an axis direction with respect to a rotation shaft 17*c*. Similarly, a plurality of driven rollers 17*b* are disposed at appropriate intervals along an axis direction with respect to a rotation shaft 17*d*.

Figure 4:
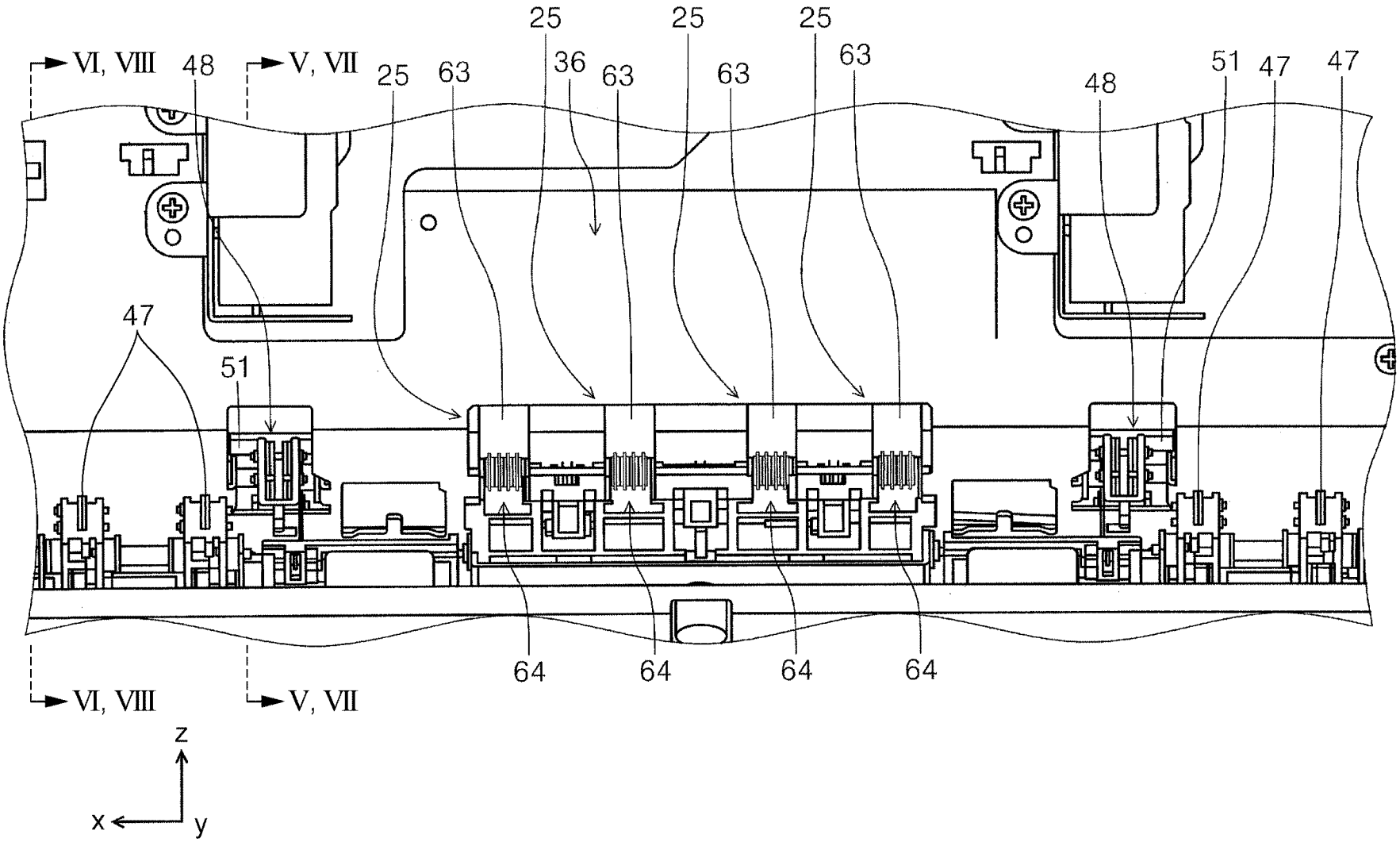
FIG. 4 is a front view illustrating a discharge mechanism section.

Between the above-described rollers, a sheet is guided by upper and lower guiding members. Although no reference numerals are given to the guiding members in FIGS. 2 to 4 for the sake of simplicity, heavy lines that connect the rollers indicate the guiding members. In FIG. 4 and subsequent figures, the guiding members are omitted as appropriate.

The recording transport path R1, which serves as a first transport path, extends under the recording head 8, which serves as a recording section for performing recording onto a sheet, to its upstream side and downstream side. In this embodiment, the recording transport path R1 is between around a position M1 and a position M2 in FIG. 3, for the sake of conveyance. In the recording transport path R1, a sheet is subjected to a feeding force from the registration roller pair 17 and a belt unit 18.

In this embodiment, the recording head 8, which serves as a recording unit, is a recording head (so-called line head) that is provided such that nozzles for ejecting ink covers the entire area in the sheet width direction to enable recording onto the entire sheet width without moving in the sheet width direction. The recording head 8 is an example processing section that performs processing to a sheet, which is an example medium.

The switchback path R2, which serves as a second transport path, is connected to the recording transport path R1. The switchback path R2 feeds a sheet that has passed under the recording head 8 (left direction in FIG. 3) and then reverses the sheet in the direction (right direction in FIG. 3) opposite to the feeding direction. The switchback path R2 is located inside a curve in the face-down discharge path R4, which will be described below. In this embodiment, the switchback path R2 is on the left side of around a position M3 in FIG. 3, for the sake of conveyance. In the switchback path R2, a sheet is subjected to a feeding force from the transport roller pair 26.

The reversing path R3, which serves as a third transport path, is connected to the switchback path R2. The reversing path R3 reverses a sheet that has been fed in the opposite direction (right direction in FIG. 3) to feed the sheet over the recording head 8 to an upstream side position (in this embodiment, an upstream position of the registration roller pair 17) of the recording head 8 in the recording transport path R1. In this embodiment, the reversing path R3 is between around the position M3 and a position M4 in FIG. 3, for the sake of conveyance. In the reversing path R3, a sheet is subjected to a feeding force from the transport roller pairs 27, 28, and 29.

The face-down discharge path R4, which serves as a fourth transport path, is connected to the recording transport path R1. The face-down discharge path R4 curves a sheet that has passed under the recording head 8 such that the surface that has faced the recording head 8 faces inward to reverse and discharge the sheet. In this embodiment, the face-down discharge path R4 is on the left side of around the position M2 in FIG. 3, for the sake of conveyance. In the face-down discharge path R4, a sheet is subjected to a feeding force from the transport roller pairs 20, 21, 22, 23, and 24 and the discharge roller pair 25. The discharge mechanism section 36 is disposed most downstream of the face-down discharge path R4 as described above.

At connection sections in the transport paths, a first flap 31 and a second flap 32 that serve as path switching sections for switching the transport paths are disposed. The first flap 31 receives a driving force from a driving unit (not illustrated) to swing about a pivot 31*a*. The second flap 32 can engage with the first flap 31 via an engaging portion (not illustrated) and swings about a pivot 32*a* in response to a swing of the first flap 31. With these flaps, a path for a sheet is set.

The overall structure of the printer 1 has been described above, and hereinafter, the discharge mechanism section 36 that is disposed most downstream of the face-down discharge path R4 to discharge a sheet obliquely upward will be described with reference to FIG. 4 and subsequent figures. As illustrated in FIG. 4, the discharge mechanism section 36 is disposed most downstream of the face-down discharge path R4 and includes the discharge roller pairs 25, which are included in the discharge section. Each of the discharge roller pairs 25 includes a driving roller 63 that is driven to rotate by a motor (not illustrated) and a driven roller 64 that is rotated. The driving roller 63 is a driving roller indicated by the reference numeral F in FIG. 3 and the driven roller 64 is a driven roller indicated by the reference numeral G in FIG. 3.

Figure 8:
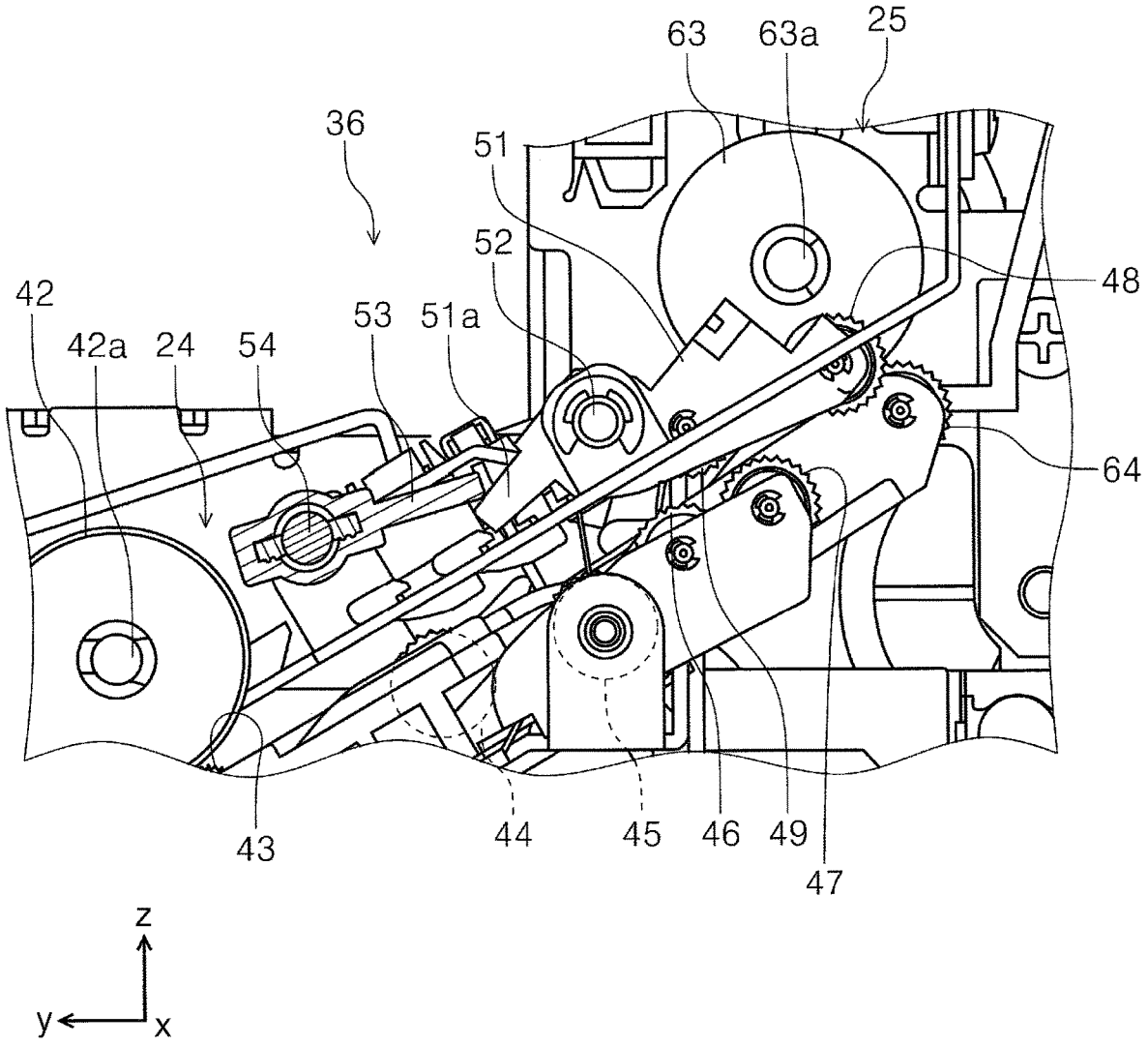
FIG. 8 is a cross-sectional view taken along the line VIII-VIII in FIG. 4 (the first contact section in the second position).

In this embodiment, a plurality of discharge roller pairs 25 are disposed at predetermined intervals in a central area in the sheet width direction (x direction). In the sheet width direction (x direction), a driven roller 48, which serves as a "first contact section", is disposed outside the discharge roller pairs 25, and a driven roller 47, which serves as a "second contact section", is disposed outside the driven roller 48. A plurality of driven rollers 47 are disposed at predetermined intervals in the sheet width direction (x direction). Specifically, the discharge roller pairs 25, which serves as the discharge section, are disposed in the central area in the sheet width direction (x direction), the driven roller 48, which serves as the first contact section, is disposed outside the discharge roller pairs 25 in the sheet width direction (x direction), and the driven rollers 47, which serve as the second contact section, are disposed outside the driven roller 48 in the sheet width direction (x direction). In the sheet transport direction, the driven roller 47 is disposed on the upstream side of the driven roller 48 (see FIG. 6 and FIG. 8). In this embodiment, the driven roller 48 is disposed so as to come into contact with a sheet from an upper side (one side) and the driven roller 47 is disposed so as to come into contact with the sheet from a lower side (the other side) to corrugate the sheet.

Specifically, in this embodiment, two spurs constitute one driven roller 48, and one driven roller 48 is disposed on one side (one side from the center) in the sheet width direction (x direction), and one spur constitutes the driven roller 47 and two driven rollers 47 are disposed on the one side (the one side from the center) in the sheet width direction (x direction). In this embodiment, at least a plurality of driven rollers 47 or a plurality of driven rollers 48 is disposed on one side (one side from the center) in the sheet width direction (x direction). With this structure, a sheet can be more reliably corrugated. Instead of the above example, on one side (one side from the center) in the sheet width direction (x direction), two pairs of driven rollers 48 may be disposed, one driven roller 47 may be disposed, or two or more pairs of driven rollers 47 and 48 may be disposed respectively, that is, a plurality of driven rollers 47 and driven rollers 48 may be disposed. In this embodiment, four spurs constitute one driven roller 64 that is a part of the discharge roller pair 25, and four driven rollers 64 are disposed in the sheet width direction (x direction). Similarly to the driven roller 48, two spurs constitute one driven roller 49 and the driven roller 49 is disposed.

Figure 5:
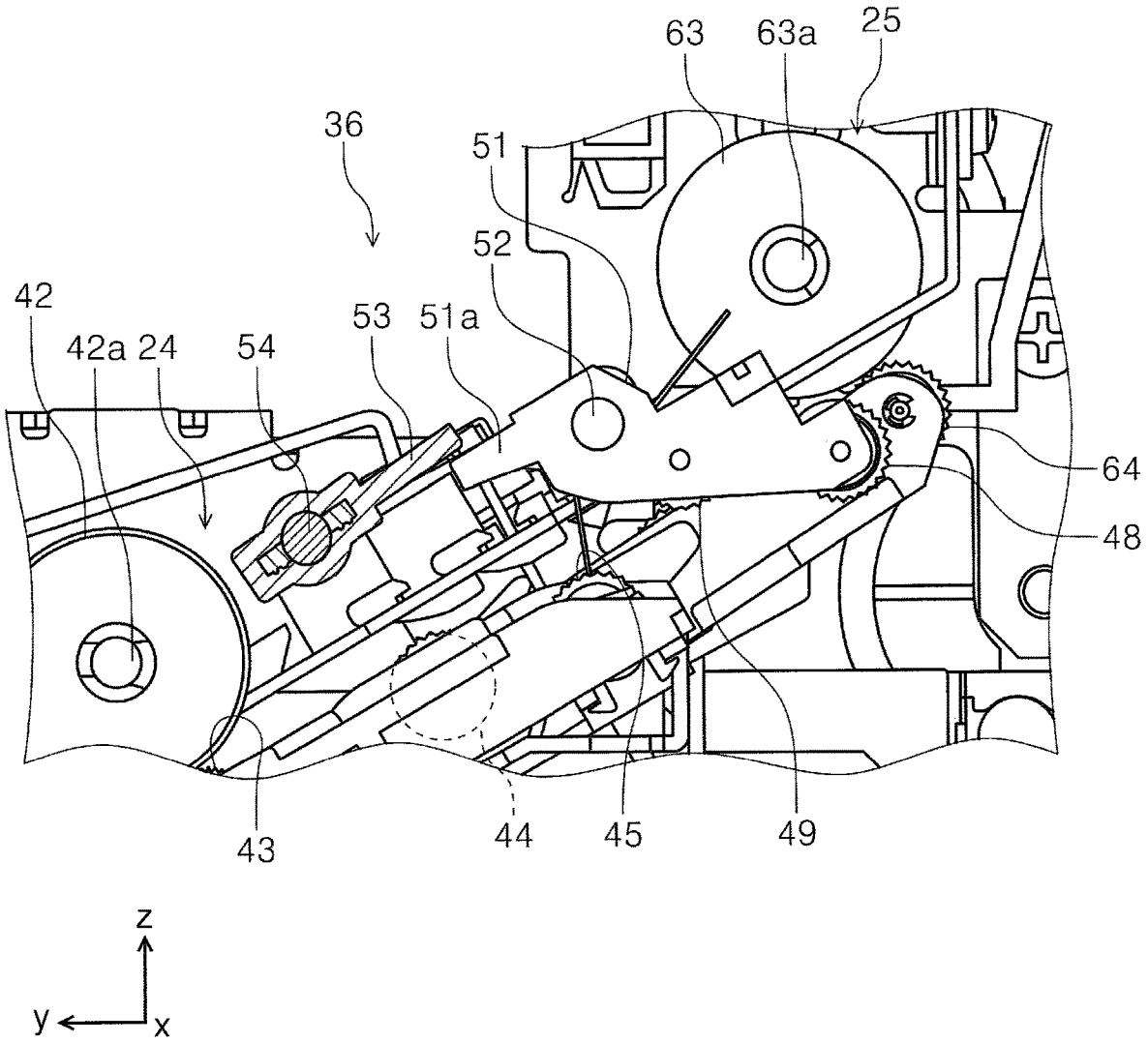
FIG. 5 is a cross-sectional view taken along the line V-V in FIG. 4 (a first contact section in a first position).
Figure 6:
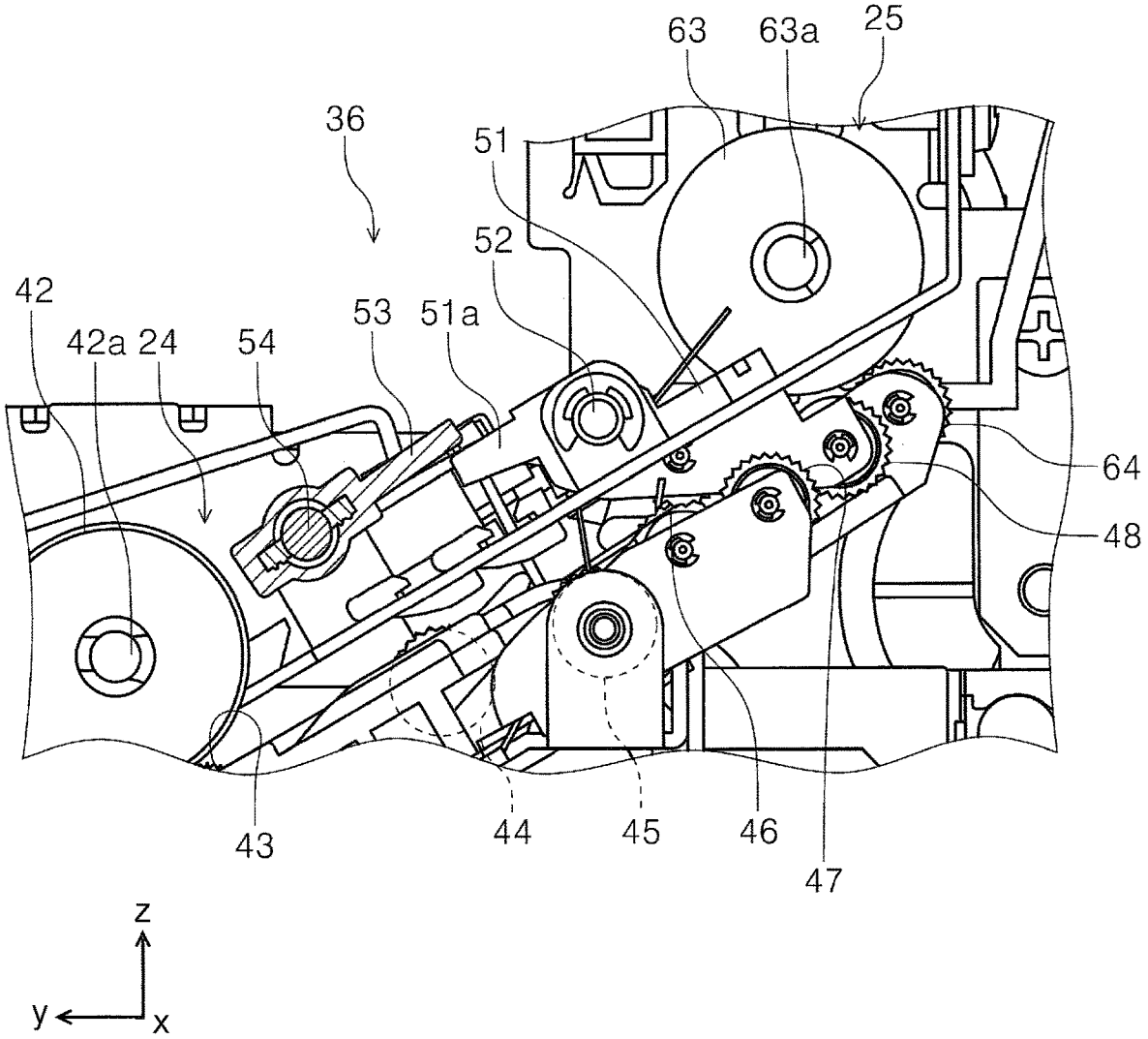
FIG. 6 is a cross-sectional view taken along the line VI-VI in FIG. 4 (the first contact section in a second position).
Figure 7:
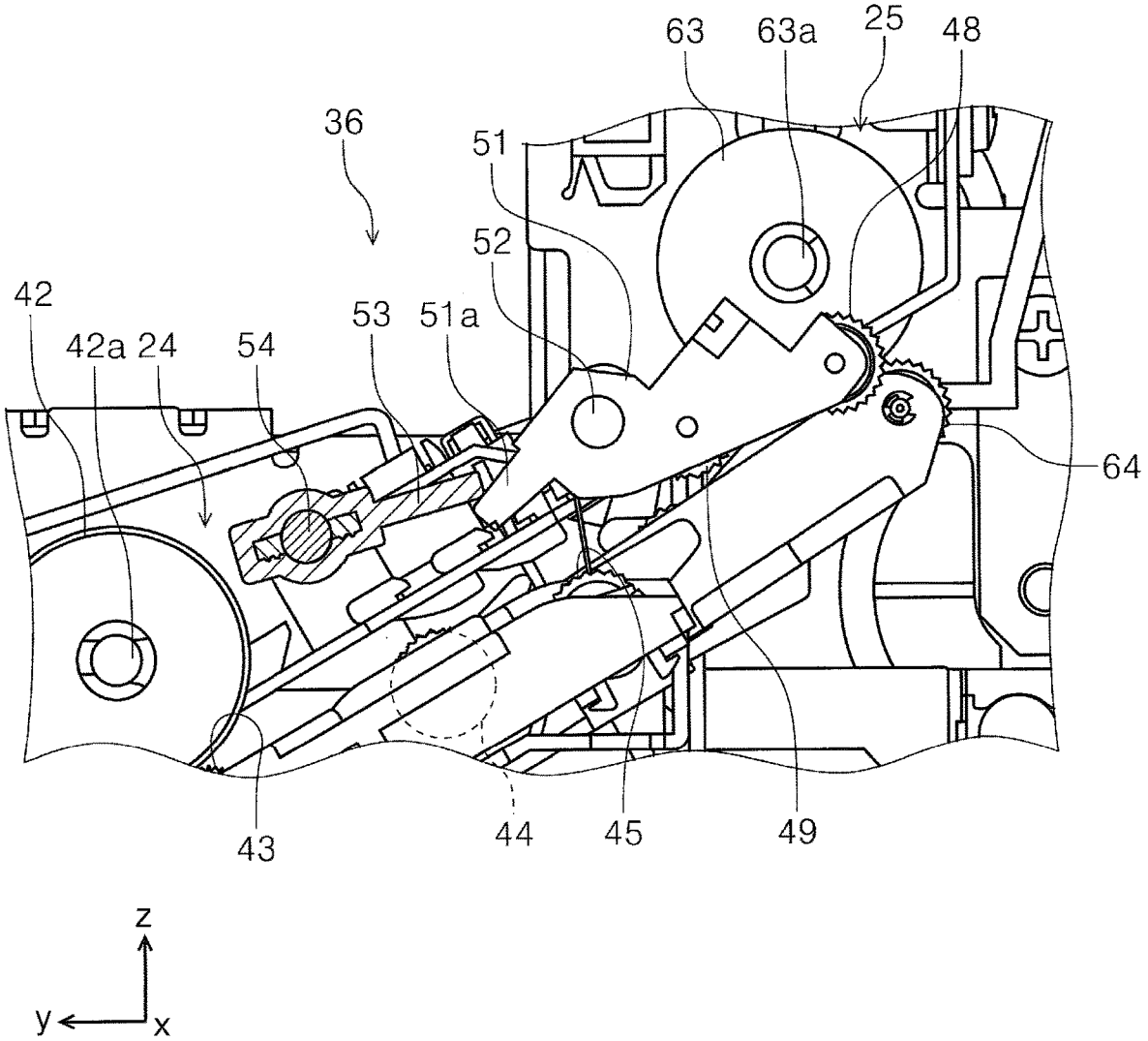
FIG. 7 is a cross-sectional view taken along the line VII-VII in FIG. 4 (the first contact section in the first position).

In FIG. 5, which is a cross-sectional view taken along the line V-V in FIG. 4, and FIG. 6, which is a cross-sectional view taken along the line VI-VI in FIG. 4, the discharge mechanism section 36 includes the transport roller pair 24, the discharge roller pair 25, and a plurality of driven rollers 44, 45, 46, 47, 48, and 49 that are disposed between the transport roller pair 24 and the discharge roller pair 25. The transport roller pair 24, which is a transport roller pair on a most upstream side in the discharge mechanism section 36, includes a driving roller 42 that is driven to rotate by a motor (not illustrated) and a driven roller 43 that is rotated. The driving roller 42 is a driving roller indicated by the reference numeral F in FIG. 3 and the driven roller 43 is a driven roller indicated by the reference numeral G in FIG. 3. A referee numeral 42*a* denotes a rotation shaft of the driving roller 42.

Among the plurality of driven rollers 44, 45, 46, 47, 48, and 49, which are disposed between the transport roller pair 24 and the discharge roller pair 25, the driven rollers 44, 45, 46, and 47 come into contact with a recording surface (lower surface) of a sheet on which recording has been made most recently, and the driven rollers 48 and 49 come into contact with a surface (upper surface) opposite to the most-recently-recorded surface of the sheet.

The driven rollers 48 and 49 are disposed in a roller supporting member 51. The roller supporting member 51 can be rotated about a rotation shaft 52 in the clockwise direction or in the counterclockwise direction in FIGS. 5 to 8. The driven rollers 48 and 49 are pressed by a spring, which serves as a pressing section (not illustrated), so as to be pressed in a direction for pressing a sheet.

Figure 11:
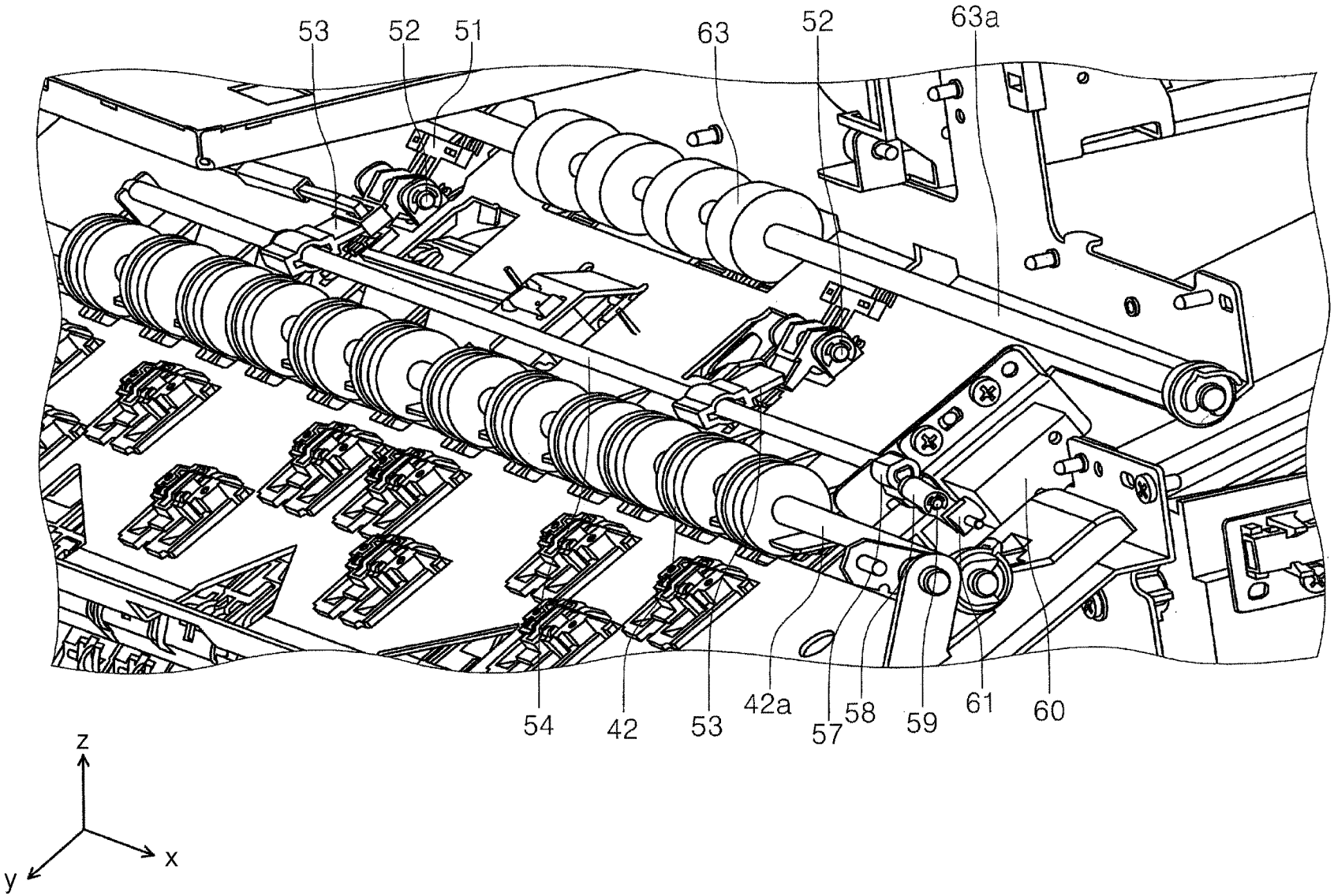
FIG. 11 is an overall perspective view of the discharge mechanism section (the first contact section in the second position).
Figure 12:
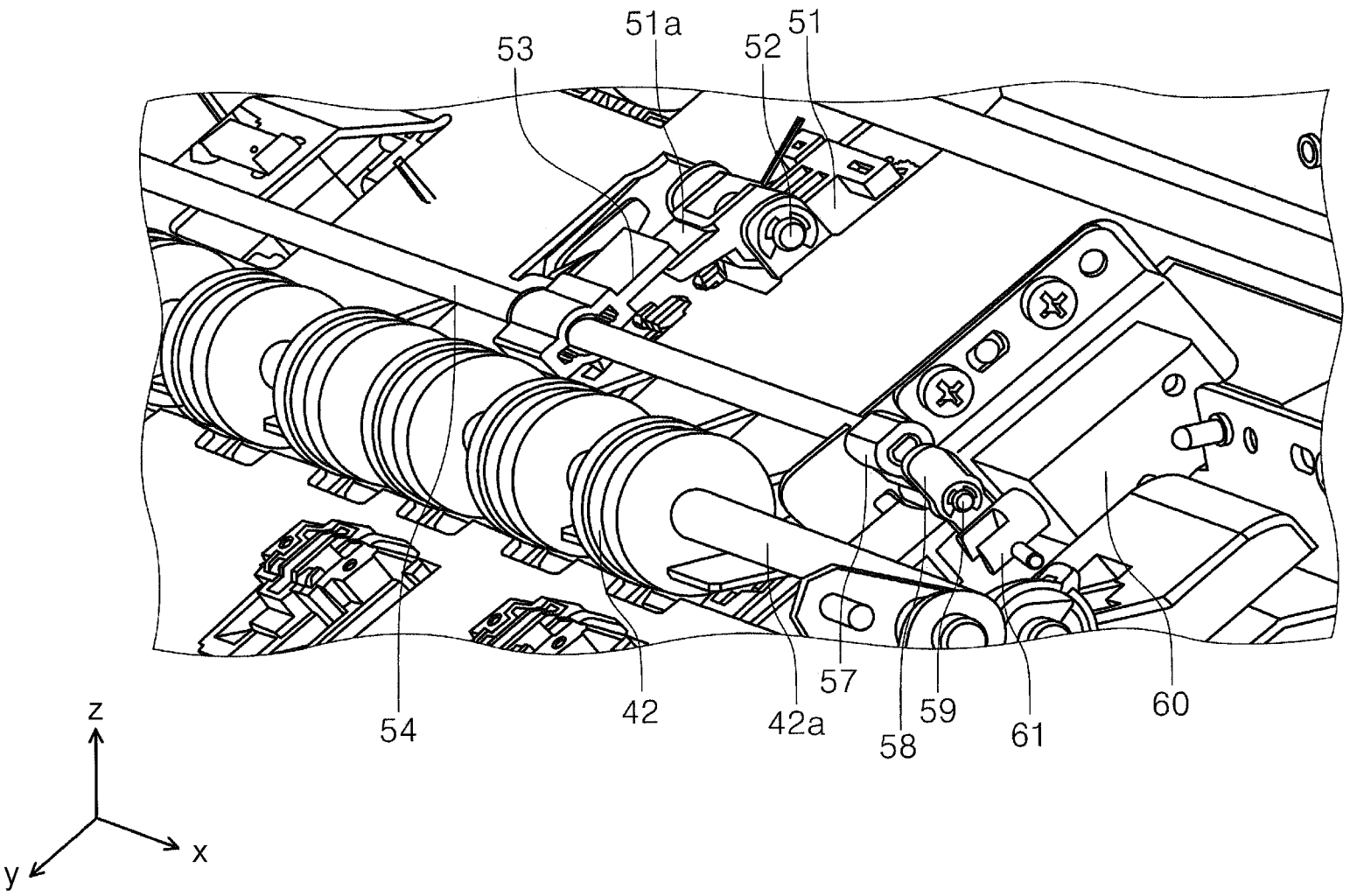
FIG. 12 is a partial enlarged perspective view of the discharge mechanism section (the first contact section in the first position).
Figure 13:
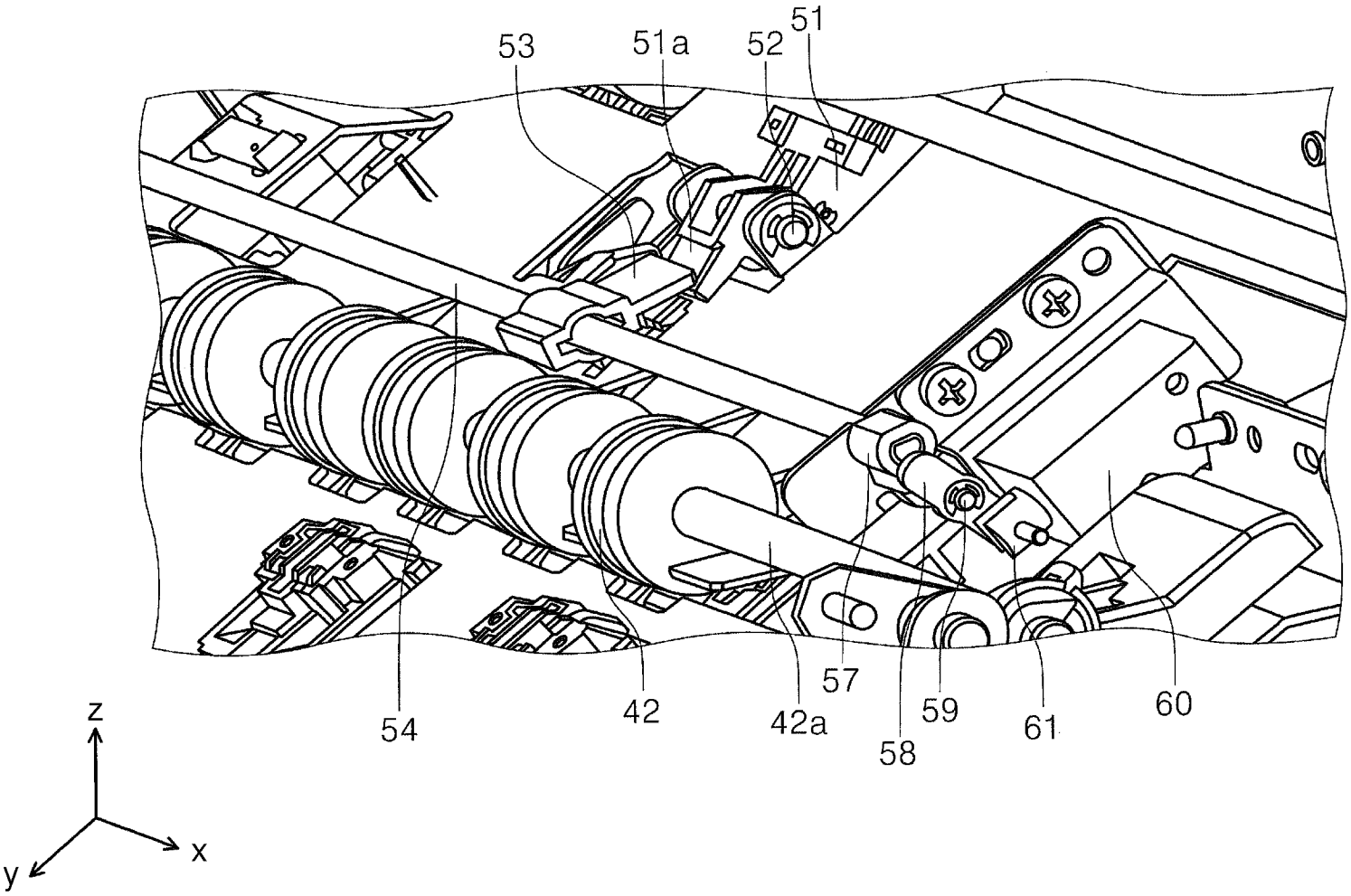
FIG. 13 is a partial enlarged perspective view of the discharge mechanism section (the first contact section in the second position).

As also illustrated in FIGS. 11 to 13, a cam member 53 is disposed so as to be engaged with the roller supporting member 51. The cam member 53 is fixed to a rotation shaft 54 and can be rotated by the rotation of the rotation shaft 54 in the clockwise direction or in the counter clockwise direction in FIGS. 5 to 8, and can be engaged with a contact section 51*a* that is provided in the roller supporting member 51 and rotated, and thereby the roller supporting member 51 can be rotated (in the clockwise direction or the counter clockwise direction in FIGS. 5 to 8).

A first cam member 57 is fixed to an end of the rotation shaft 54 as illustrated in FIGS. 11 to 13. The first cam member 57 can be subjected to a rotation force via a second cam member 58 that can rotate about a rotation shaft 59. The second cam member 58 can be engaged with a plunger 61 in a solenoid 60 and can be rotated as the plunger 61 is moved forward or backward by the solenoid 60. The rotation of the second cam member 58 rotates the first cam member 57, that is, rotates the rotation shaft 54.

The rotation of the rotation shaft 54 rotates the roller supporting member 51 and thereby the driven rollers 48 and 49 that are supported by the roller supporting member 51 can move toward or away from the sheet transport path. With this structure, from the viewpoint of the driven roller 48, which serves as the first contact section, the driven roller 48 comes into contact with a sheet that is transported in the sheet transport path (face-down discharge path R4) toward the discharge roller pair 25 from one side, which is one surface side of the sheet, toward the other side, which is the other surface side of the sheet. In this embodiment, an upper surface of the sheet in FIGS. 5 to 8 is the one surface and a lower side of the sheet is the other surface. The driven roller 48 can be switched between a first position (FIG. 5 and FIG. 6) for pressing a sheet and a second position (FIG. 7 and FIG. 8) that is closer to the one side than the first position. For the sake of clarity, in the following description, the first position of the driven roller 48 is referred to as "pressing position", and the second position is referred to as "retracted position". Furthermore, the one surface side is referred to as "upper side", and the other surface side is referred to as "lower side".

Figure 9:
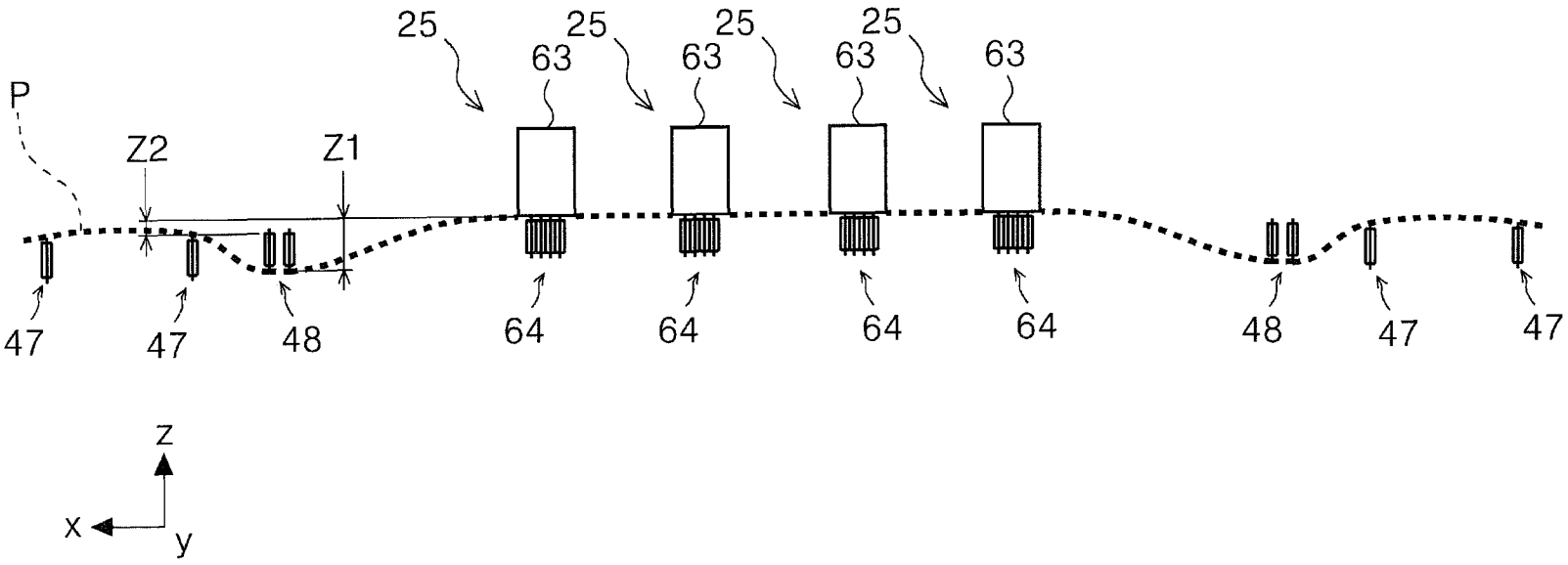
FIG. 9 is a front view of some rollers in the discharge mechanism section (the first contact section in the first position).

The operation of the driven roller 48 will be further described with reference to FIG. 9 and FIG. 10. As illustrated in FIG. 9, when the driven rollers 48 are in the pressing position, by the driven rollers 48 and the driven rollers 47, which are disposed at positions outside the positions of the driven rollers 48 in the sheet width direction (x direction) so as to come into contact with a sheet P that is being transported and to press the sheet P toward the upper side, the sheet P is waved in the sheet width direction (x direction), specifically, the sheet P is corrugated in the sheet width direction (x direction). The corrugations have portions protruding upward at the positions of the driven rollers 47 and have portions protruding downward at the positions of the driven rollers 48. These corrugations increase the stiffness of the discharged sheet P in the discharge direction, reduces curling regardless of ink absorption, and provides good stacking properties.

In FIG. 9, a dimension Z1 indicates a dimension in a height direction (z direction) between a position where the driven roller 48 comes into contact with a sheet P when the driven roller 48 is in the pressing position and a position where the discharge roller pair 25 nips the sheet P, and a dimension Z2 indicates a dimension in the height direction (z direction) between a position where the driven roller 47 comes into contact with the sheet P and the position where the discharge roller pair 25 nips the sheet P. In this embodiment, the dimension Z1 is larger than the dimension Z2. Specifically, the position where the driven roller 48 that is in the pressing position comes into contact with the sheet P is farther than the position where the driven roller 47 comes into contact with the sheet P with respect to the position where the discharge roller pair 25 comes into contact with the sheet P in the direction (height direction) intersecting the surface of the sheet P. From another viewpoint, the position where the driven roller 48 that is in the pressing position comes into contact with the sheet P is lower than the position where the driven roller 47 comes into contact with the sheet P. From still another viewpoint, the position where the driven roller 47 comes into contact with the sheet P is higher than the position where the driven roller 48 that is in the pressing position comes into contact with the sheet P and lower than the position where the discharge roller pair 25 comes into contact with the sheet P. With the above-described structure, the sheet P can be reliably corrugated in the sheet width direction (x direction). For example, the dimension Z1 may be set to approximately 8 mm, and for example, the dimension Z2 may be set to approximately 1 mm.

Figure 10:
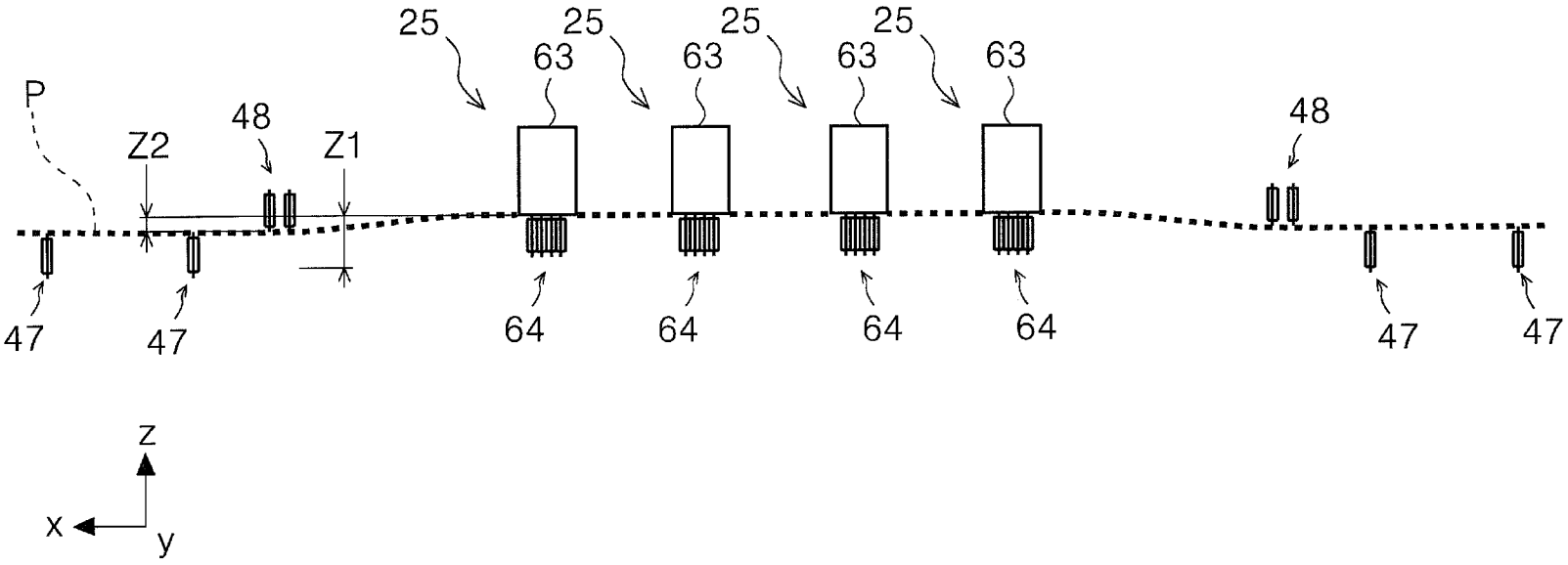
FIG. 10 is a front view of some rollers in the discharge mechanism section (the first contact section in the second position).

The driven rollers 48 can be switched from the pressing position as in FIG. 9 to the retracted position as in FIG. 10. As shown in the change from FIG. 9 to FIG. 10, the corrugations formed in the sheet P along the sheet width direction (x direction) are largely released by the driven rollers 48 that are changed to the retracted positions. This positional change releases the pressing force of the driven rollers 48 and the driven rollers 47 for pressing the surface of the sheet P and can reduce the occurrence of damage to the sheet P.

In this embodiment, as illustrated in FIG. 10, the positions where the driven rollers 48 that are in the retracted positions come into contact with the sheet P are substantially the same height as the height of the positions where the driven rollers 47 come into contact with the sheet P. Consequently, even if the driven rollers 48 are switched to the retracted positions, it can be expected that the waved shapes (the above-described corrugated shapes) will remain to some extend in the sheet P and the curl reducing effect can be continuously achieved. To achieve such a function effect, the position where the driven roller 48 that is in the retracted position comes into contact with the sheet P may be lower than the position where the driven roller 47 comes into contact with the sheet P.

Instead of the above, the position where the driven roller 48 that is in the retracted position comes into contact with the sheet P may be set to a position higher than the position where the driven roller 47 comes into contact with the sheet P. With this structure, the pressing force of the driven rollers 48 and the driven rollers 47 for pressing the surface of the sheet P can be more reliably released and the occurrence of damage to the sheet P can be more reliably reduced.

Figure 14A:
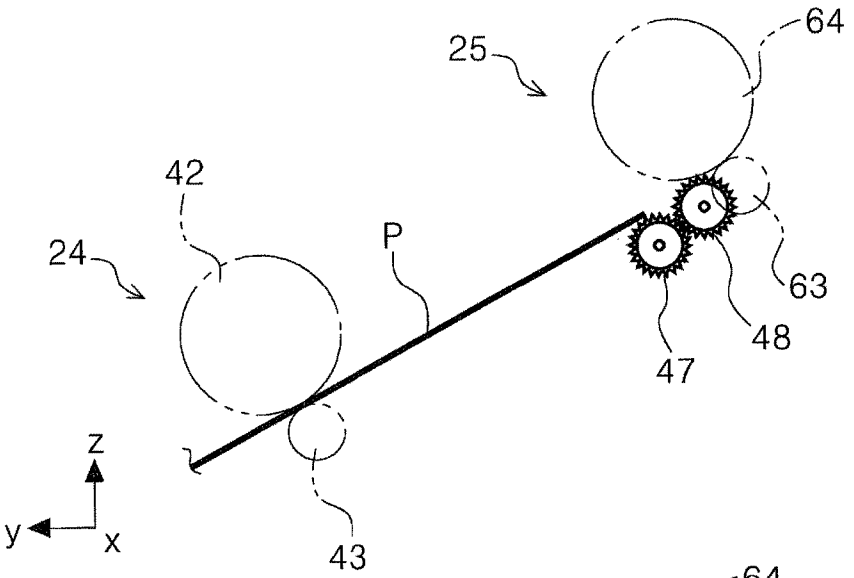
FIGS. 14A and 14B are side views of the discharge mechanism section illustrating a state in which a sheet is being discharged.
Figure 14B:
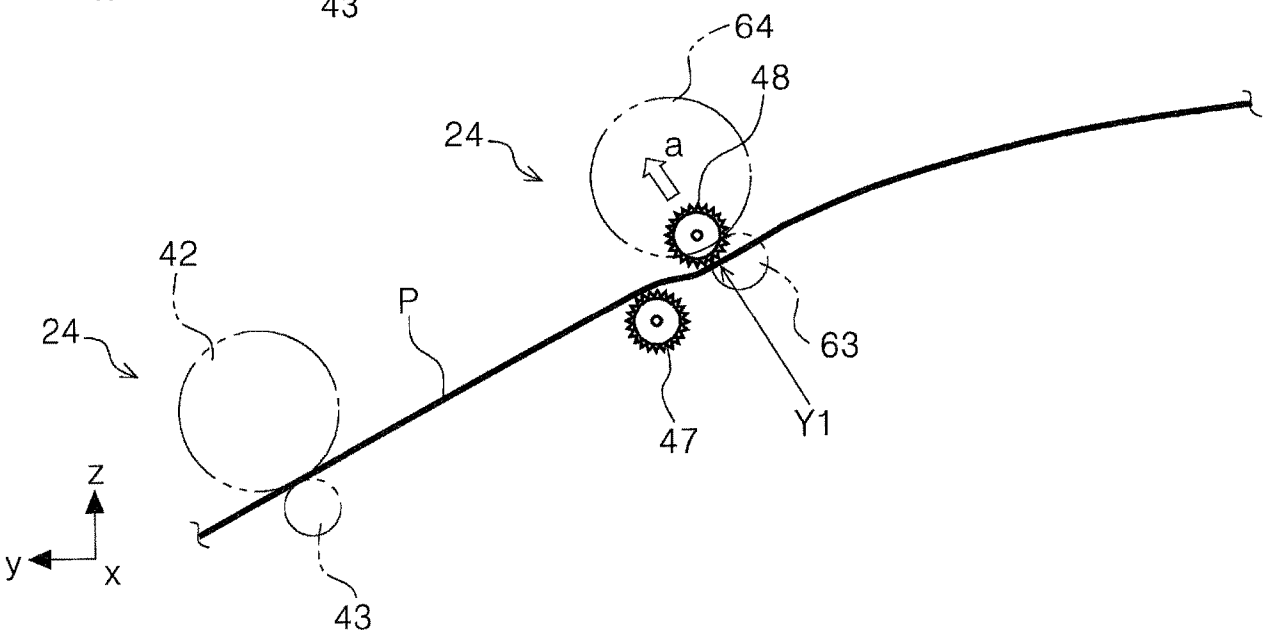
Figure 15:
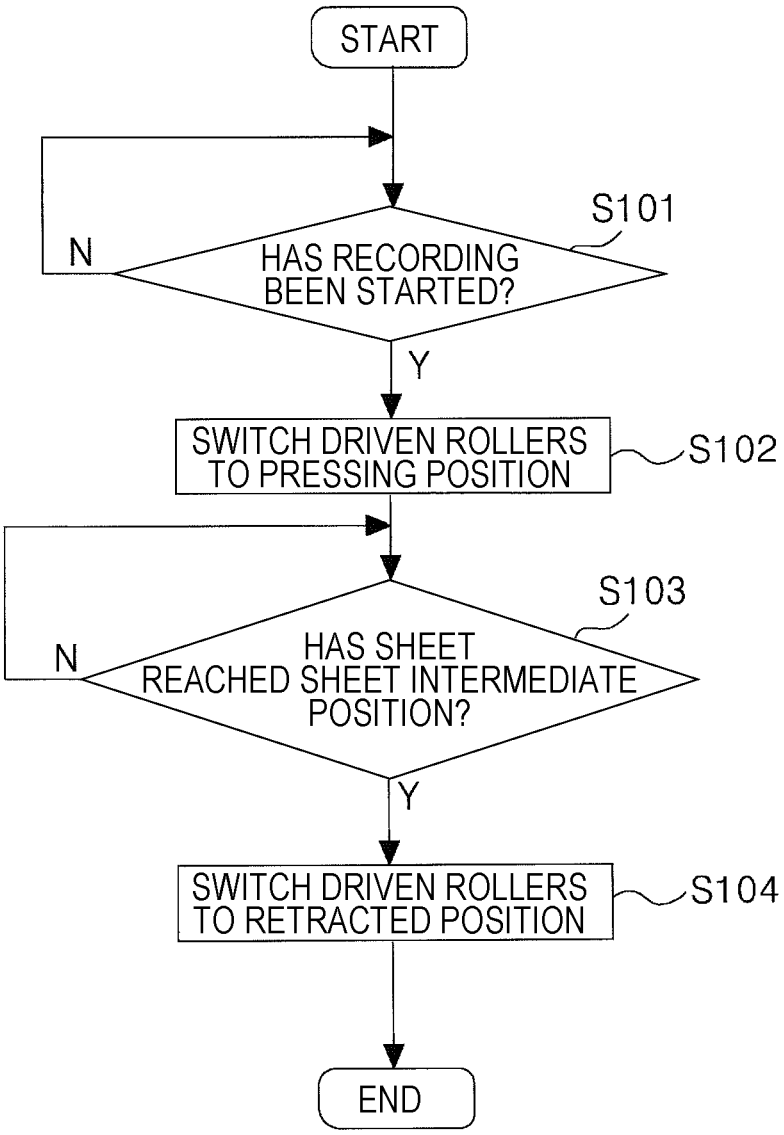
FIG. 15 is a flowchart illustrating the control processing to be performed in the discharge mechanism section.

A specific example of the switching of the driven rollers 48 between the pressing position and the retracted position will be described with reference to FIGS. 14A and 14B and FIG. 15. It is assumed that, before the start of the recording operation, the driven rollers 48 are in the retracted position. In FIG. 15, after the recording operation is started (Y in step S101), the controller 9 (FIG. 2) causes the driven rollers 48 to be switched from the retracted position to the pressing position (step S102). At this time point, a sheet P has not been fed to the face-down discharge path R4. Accordingly, when the sheet P is fed to the face-down discharge path R4 and the leading edge of the sheet reaches the driven rollers 48, the sheet P is nipped by the driven rollers 48 that are in the pressing position as illustrated in FIG. 14A, and the sheet P is corrugated as illustrated in FIG. 9.

The controller 9 monitors whether a central position Y1 (FIG. 14B) in the transport direction in the recorded sheet P has reached the position (nip position) of the discharge roller pair 25 (step S103). If the central position Y1 in the sheet P has reached the position (Y in step S103), the controller 9 causes the driven rollers 48 to be switched to the retracted position indicated by the arrow a in FIG. 14B (step S104). Specifically, the driven rollers 48 are switched from the pressing position to the retracted position before the trailing edge of the sheet P passes through the driven rollers 48. The controller 9 can determine whether the sheet central position Y1 has reached the discharge roller pair 25 based on a paper size that has been obtained from driver information and information obtained from a sheet passage detection sensor (not illustrated) that is provided in the sheet transport path.

Specifically, when the central position Y1 in the discharge direction in the sheet P has reached the discharge roller pair 25, the position of the center of gravity in the sheet P is on the downstream side of the discharge roller pair 25, and the portion of the sheet P on the downstream side (portion on the right side of the central position Y1 in FIG. 14B) will automatically fall with the nip position of the discharge roller pair 25 as a fulcrum. Accordingly, the portion of the sheet P on the upstream side (portion on the left side of the central position Y1 in FIG. 14B) comes into contact with the driven rollers 48 with a stronger force and the sheet P is more likely to be damaged by the driven rollers 48.

In such a case, the controller 9 switches the driven rollers 48 from the pressing position to the retracted position. This operation effectively reduces the occurrence of the damage to the sheet P by the driven rollers 48. The timing of switching the driven rollers 48 from the pressing position to the retracted position is not limited to the above-described timing; alternatively, other timings during the discharge of the sheet P by the discharge roller pair 25 may be employed. Such a timing may be appropriately set by a person skilled in the art based on the necessity of pressing a sheet by the driven rollers 48 to reduce curling and the necessity of retracting the driven rollers 48 to reduce damage.

The switching of the driven rollers 48 from the pressing position to the retracted position may be performed step by step. For example, at least one intermediate position may be provided between the pressing position and the retracted position and the driven rollers 48 may be temporarily stopped at the intermediate position. This structure can reduce sudden change in the orientation of the sheet P in discharging the sheet P and good stacking properties can be achieved. In addition to the step-by-step switching of the driven rollers 48 from the pressing position to the retracted position, power of a motor or the like may be used instead of the solenoid 60 (FIG. 11) as a switching drive source and the switching from the pressing position to the retracted position may be performed at a low speed to achieve similar functional effect.

The switching of the driven rollers 48 from the pressing position to the retracted position may be performed depending on the paper type. Specifically, depending on the paper type, the control process in step S102 in FIG. 15 may be omitted. For example, if paper that has high stiffness such as thick paper is used, since the paper does not easily curl, it is substantially not necessary to set the driven rollers 48 to the pressing position to corrugate the paper to reduce curling to achieve good stacking properties. Moreover, in the case of the paper that has high stiffness, the pressure from the driven rollers 48 would damage the paper surface. Accordingly, in such a case, the processing in step S102 in FIG. 15 is skipped and the driven rollers 48 are not switched to the pressing position.

On the other hand, if paper that has low stiffness such as thin paper is used, since the paper easily curl, it is necessary to set the driven rollers 48 to the pressing position to corrugate the paper to reduce curling to achieve good stacking properties. Accordingly, in such a case, the processing in step S102 in FIG. 15 is performed and the driven rollers 48 are switched to the pressing position. As described above, appropriate discharging suitable for individual paper type can be performed.

The retracted position of the driven rollers 48 is not limited to one, and a plurality of positions may be set. Furthermore, in such a case, the retracted positions may be set for each paper type. For example, for paper (hereinafter, referred to as "first paper") that tends to easily curl due to ink absorption, the driven rollers 48 may be set to a pressing position (hereinafter, referred to as a "first pressing position") at which the driven rollers 48 can press the paper with a strongest force. For paper (hereinafter, referred to as "second paper") that needs the pressure from the driven rollers 48 to reduce curling but is relatively hard to curl as compared to the first paper, the driven rollers 48 may be set to a second pressing position at which a pressing force weaker than that at the first pressing position is provided. With such a structure, appropriate discharging suitable for individual paper type can be performed.

It is to be understood that the disclosure is not limited to the above-described embodiments, various modifications can be made within the scope of the following claims, and these modifications are included within the scope of the disclosure. For example, in the above-described embodiments, the recording section including the recording head has been described as the processing section. Alternatively, the processing section may be a reading section that includes an image reading sensor in the scanner section 3. In such a case, the discharge section is a discharge section for discharging a document from the reading section that reads the document while transporting the document. Furthermore, in the above-described embodiments, for example, a sheet is discharged face down and in single-sided recording, at least a recording surface of the sheet is not damaged by the first contact section. Consequently, in the case of the single-sided recording, since the sheet is to be corrugated first to increase the stiffness in the single-sided recording, the first contact section may not be switched to the second position.

What is claimed is:

1. A processing apparatus comprising:

a processing section configured to perform processing to a medium, the medium having a one side facing a one side of the processing apparatus and another side facing the other side of the processing apparatus;

a discharge section configured to discharge the medium that has been transported from the processing section along a medium transport path in a medium transport direction;

a first contact section configured to come into contact with the one side of the medium that has passed through the processing section and being transported toward the discharge section in the medium transport path to press the medium from the one side toward the other side; and a second contact section configured to come in contact with the other side of the medium that has passed through the processing section and being transported toward the discharge section in the medium transport path to press the medium from the other side toward the one side, wherein the first contact section is switched between a first position for pressing the medium and a second position that is closer to the one side of the processing apparatus than the first position, wherein the first contact section is maintained in the first position when a first type of medium is passing through the first contact section; and the first contact section is maintained in the second position when a second type of medium is passing through the first contact section, and wherein the second contact section deforms the medium toward the one side.

2. The processing apparatus according to claim 1, wherein the second contact section is disposed away from the first contact section in a medium width direction that is a direction intersecting the medium transport direction.

3. The processing apparatus according to claim 2, wherein the discharge section is disposed in a central area in the medium width direction, the first contact section is disposed outside the discharge section in the medium width direction, and the second contact section is disposed outside the first contact section in the medium width direction.

4. The processing apparatus according to claim 3, wherein the position at which the first contact section in the first position comes into contact with the medium is closer to the other side than the position at which the second contact section comes into contact with the medium.

5. The processing apparatus according to claim 2, wherein the second contact section is on an upstream side of the first contact section in the medium transport path.

6. The processing apparatus according to claim 2, wherein the first contact section is disposed at a higher position with respect to the medium transport path and the second contact section is disposed at a lower position with respect to the medium transport path.

7. The processing apparatus according to claim 6, wherein the position at which the second contact section comes into contact with the medium is higher than the position at which the first contact section in the first position comes into contact with the medium and is lower than the position at which the discharge section comes into contact with the medium.

8. The processing apparatus according to claim 7, wherein the position at which the first contact section in the second position comes into contact with the medium is a substantially the same height as the position at which the second contact section comes into contact with the medium or is lower than the position at which the second contact section comes into contact with the medium.

9. The processing apparatus according to claim 7, wherein the position at which the first contact section in the second position comes into contact with the medium is higher than the position at which the second contact section comes into contact with the medium.

10. The processing apparatus according to claim 2, wherein a plurality of the first contact sections, or a plurality of the second contact sections, or a plurality of first contact sections and the second contact sections are disposed in the medium width direction.

11. The processing apparatus according to claim 1, wherein when a leading edge of the medium reaches the first contact section, the first contact section is in the first position and by the time a trailing edge of the medium passes through the first contact section, the first contact section is switched from the first position to the second position.

12. The processing apparatus according to claim 11, wherein the first contact section is switched from the first position to the second position when a central position of the medium in the discharge direction reaches the discharge section.

13. The processing apparatus according to claim 11, wherein the first contact section is switched from the first position to the second position step by step.

14. The processing apparatus according to claim 1, wherein depending on the type of medium, a discharging operation to be performed in a state in which the first contact section is in the first position and a discharging operation to be performed in a state in which the first contact section is in the second position are switched.

15. The processing apparatus according to claim 1, wherein the processing section comprises a recording unit configured to perform recording onto the medium.

16. The processing apparatus according to claim 1, the processing apparatus further comprising:

a controller configured to detect a position of the medium and to control the first contact section, wherein when a recording operation starts, the controller causes the first contact section to be switched from the second position to the first position, and when a central position of the medium reaches the first contact section, the controller causes the first contact section to be switched from the first position to the second position.

17. The processing apparatus according to claim 1, wherein:

when the first contact section is in the first position, a portion of the first contact section that comes into contact with the medium is at a position that is lower than a portion of the second contact section that comes into contact with the medium to cause the medium between the first contact section and the second contact section to curve in a medium width direction, and when the first contact section is in the second position, the portion of the first contact section that comes into contact with the medium and the portion of the second contact section that comes into contact with the medium have substantially a same height to cause the medium between the first contact section and the second contact section to be substantially flat in the medium width direction.

* * * * *